US005241737A

United States Patent [19]

Colvin

[11] Patent Number: 5,241,737

[45] Date of Patent: Sep. 7, 1993

[54] METHOD OF MAKING A COMPOSITE CASTING

[75] Inventor: Gregory N. Colvin, Muskegon, Mich.

[73] Assignee: Howmet Corporation, Greenwich, Conn.

[21] Appl. No.: 938,780

[22] Filed: Sep. 1, 1992

Related U.S. Application Data

[63] Continuation-in-part of Ser. No. 672,945, Mar. 21, 1991, abandoned.

[51] Int. Cl.[5] ..... B22D 19/02; B23P 17/00

[52] U.S. Cl. ..... 29/526.2; 29/527.5; 164/98; 164/112

[58] Field of Search ..... 164/112, 98, 334, 332; 249/91; 29/526.2, 526.3, 527.5

[56] References Cited

U.S. PATENT DOCUMENTS

| | | | |
|---|---|---|---|
| 2,084,247 | 6/1937 | Dockray et al. . | |
| 2,161,116 | 6/1939 | White . | |
| 2,745,437 | 5/1956 | Comstock . | |
| 3,596,703 | 8/1971 | Bishop et al. . | |
| 3,659,645 | 5/1972 | Rose . | |
| 3,819,145 | 6/1974 | Huber et al. . | |
| 4,008,052 | 2/1977 | Vishnevsky | 164/75 X |
| 4,250,610 | 2/1981 | Wilbers et al. | 29/526.2 X |
| 4,487,246 | 12/1984 | Frasier . | |
| 4,572,270 | 2/1986 | Funatani et al. . | |
| 4,811,778 | 3/1989 | Allen et al. . | |
| 4,889,177 | 12/1989 | Charbonnier et al. . | |

FOREIGN PATENT DOCUMENTS

| | | |
|---|---|---|
| 58-61959 | 4/1983 | Japan . |
| 58-209464 | 12/1983 | Japan . |
| 59-82157 | 5/1984 | Japan . |
| 60-158968 | 8/1985 | Japan . |
| 16286 | of 1913 | United Kingdom . |
| 2098112A | 11/1982 | United Kingdom . |

*Primary Examiner*—Batten, Jr., J. Reed

*Attorney, Agent, or Firm*—Flynn, Thiel, Boutell & Tanis

[57] ABSTRACT

A casting mold includes a melt-receiving mold cavity having a preformed metallic or intermetallic insert suspended therein by one or more first elongated, slender suspension members fixed at one end to the insert and at another end to the mold to locate the insert in a first direction in the mold and by one or more second elongated, slender suspension members fixed at one end to the insert and abutting the mold at another end to locate the insert in a second direction in the mold. A melt of metallic or intermetallic material is introduced into the mold cavity about the suspended insert and the suspension members and is solidified to form a composite casting. The casting is subjected to elevated temperature/elevated isostatic gas pressure conditions wherein the interface between the suspension members and the cast melt is effective to inhibit gas penetration between the insert and cast melt, thereby allowing a sound, void-free, contamination-free metallurgical bond to be produced between the insert and the cast melt.

13 Claims, 1 Drawing Sheet

METHOD OF MAKING A COMPOSITE CASTING

This is a continuation-in-part application of U.S. Ser. No. 07/672,945, filed Mar. 21, 1991, and now abandoned.

FIELD OF THE INVENTION

The present invention relates to a method of making a composite casting, as well as casting produced thereby, having a preformed metallic or intermetallic insert, such as, for example, a reinforcement insert comprising a metal matrix composite, bonded in a preselected position therein.

BACKGROUND OF THE INVENTION

Components for aerospace, automotive and like service applications have been subjected to the ever increasing demand for improvement in one or more mechanical properties, such as tensile strength, ductility, fatigue life, resistance to impact damage, etc., while at the same time maintaining or reducing the weight of the component. To this end, the Charbonnier, et al U.S. Pat. No. 4,889,177 describes a method of making a composite casting wherein a molten lightweight alloy, such as aluminum or magnesium, is counter-gravity cast into a gas permeable sand mold having a fibrous insert of high strength ceramic fibers positioned therein by metallic seats so as to be incorporated into the casting upon solidification of the molten alloy.

The Funatani, et al U.S. Pat. No. 4,572,270 describes a method of making a composite casting to this same end wherein a mass of high strength reinforcing material, such as ceramic fibers, wiskers, or powder, is incorporated into a lightweight metal matrix (e.g., aluminum or magnesium) that is die cast around the reinforcing mass in a pressure chamber.

A technique commonly referred to as bicasting has been employed in attempts to improve one or more mechanical properties of superalloy castings for use as aerospace components. Bicasting involves pouring molten metal into a mold cavity in which a preformed insert is positioned in a manner to augment one or more mechanical properties in a particular direction(s). The molten metal surrounds the insert and, upon solidification, yields a composite casting comprising the insert embedded in and hopefully soundly bonded with the cast metal without contamination therebetween. However, as described in U.S. Pat. No. 4,008,052, attempts at practicing the bicasting process have experienced difficulty in consistently achieving a sound metallurgical bond between the insert and the metal cast therearound without bond contamination. Moreover, difficulty has been experienced in positioning the insert in the mold cavity and thus the final composite casting within required location tolerances. The inability to achieve on a reliable and reproducible basis a sound, contamination-free bond between the insert and the cast metal has significantly limited use of bicast components in applications, such as aerospace components, where reliability of the component in service is paramount.

It is an object of the invention to provide an improved bicasting type of process for making a composite casting wherein a sound, contamination-free metallurgical bond is reliably and reproducibly produced between the preformed insert and the cast metal therearound without compromise to properties of either component.

It is another object of the invention to provide an improved bicasting type of process for making a composite casting wherein positioning of the preformed insert in the mold cavity and thus in the final composite casting within required location tolerances is achievable.

SUMMARY OF THE INVENTION

The present invention involves a method of making a composite casting, as well as a casting produced thereby, wherein a casting mold is provided having a melt-receiving mold cavity and a preformed metallic or intermetallic insert is suspended in a predetermined position in the mold cavity by one or more first elongated, slender suspension members fixed (e.g. joined) at one (inner) end to the insert and fixed at another (outer) end to the mold to locate the insert in a first direction in the mold cavity and by one or more second elongated, slender suspension members fixed (e.g. joined or bonded) at one (inner) end to the insert and engaged at another (outer) end to the mold to locate the insert in a second direction in the mold cavity. The slender suspension members have a cross-section (e.g. thickness or diameter) large enough to support the insert and small enough to be heated substantially by the melt to insure bonding with the surrounding melt. A melt is introduced into the mold cavity about the suspended insert and about at least a portion of the suspension members and is solidified to provide a composite casting. The method preferably involves the further step of subjecting the casting to elevated temperature and isostatic gas pressure conditions wherein the interface between the suspension member and the cast melt therearound is effective to inhibit gas penetration between the preformed insert and the cast melt therearound so as to produce a sound, void-free, contamination-free metallurgical bond between the insert and the cast melt.

In one embodiment of the invention, one or more of the first suspension members can be employed at opposite ends of the insert to locate the insert longitudinally in the mold cavity. One or more second suspension members can be employed at opposite lateral sides of the insert to locate the insert transversely in the mold cavity.

In another embodiment of the invention, the suspension members and cast melt are at least sufficiently metallurgically bonded to aid in inhibiting penetration of the isostatic gas pressure between the preformed insert and the cast melt therearound. Preferably, the suspension members are partially melted by the melt cast into the mold to enhance such metallurgical bonding. The suspension members may include a melting point depressant to facilitate melting thereof. Use of a melting point depressant would be appropriate where larger cross-section suspension members are required to support the insert in the mold and where the temperature rise of the suspension members is insufficient to promote bonding with the melt.

In another embodiment of the invention, the outer ends of the first suspension members (fixed to the mold) are received in an ingate passage of the mold that supplies the melt to the mold cavity and are fixed in position in a locating depression or aperture therein so as to locate the insert in the preselected position in the mold cavity. Alternately or in addition, the outer ends of the same or different suspension members are received in a riser passage of the mold and fixed in position therein so as to locate the insert in the preselected position.

In still another embodiment of the invention, the outer ends of the second suspension members are abutted against the mold cavity wall without being affixed thereto.

In still another embodiment of the invention, the preformed insert comprises a metallic or intermetallic material which may include reinforcements, such as reinforcing filaments, particulates, etc. therein. An exemplary preformed insert comprises a metal matrix composite. The metallic or intermetallic material of the insert may correspond substantially in composition to the melt introduced into the mold cavity.

DETAILED DESCRIPTION OF THE INVENTION

Figure 1:
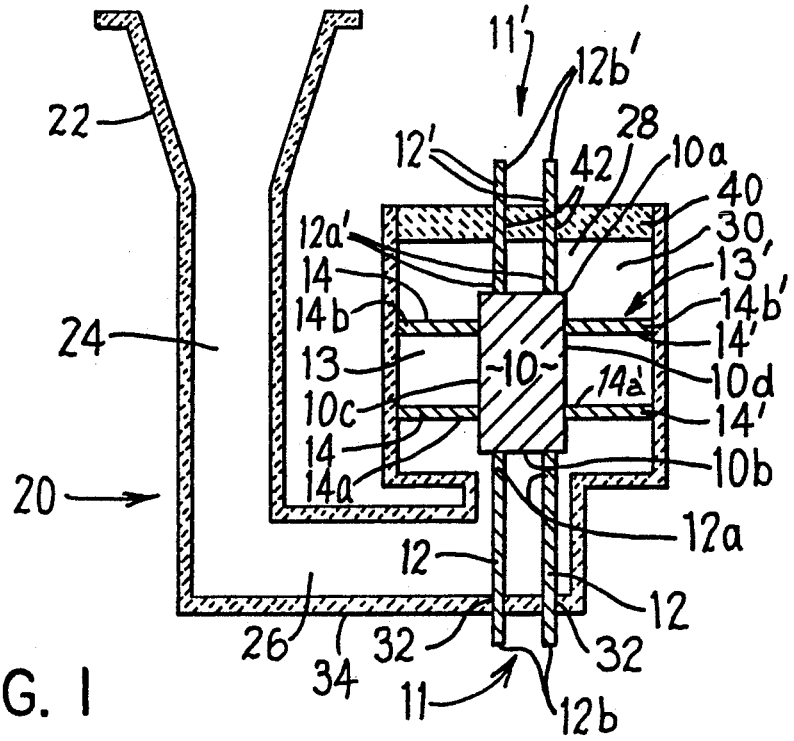
FIG. 1 is a schematic side elevational view of the ceramic shell mold with a preformed insert positioned in the mold cavity thereof by a pair of longitudinally extending suspension members (i.e., pins) fixed to opposite ends thereof and by a pair of transversely extending suspension members fixed to opposite lateral sides thereof.

Referring to FIG. 1, a preformed insert 10 is shown located in desired position in a mold 20 by first and second pairs 11,11' of first elongated, slender, longitudinally (axially) extending suspension members 12,12' affixed to opposite axial ends **10*b*,10*b* of the preform and by first and second pairs 13,13' of second elongated, slender transversely (laterally) extending suspension members 14,14' affixed to opposite lateral sides 10*c*,10*d* of the preform in accordance with one embodiment of the invention. In the particular embodiment shown, each suspension member 12,12'; 14,14' comprises an elongated, slender cylindrical pin having one inner end 12*a*,12*a*'; 14*a*,14*a*' welded or otherwise affixed to the preform 10 and another opposite outer end, 12*b*,12*b*'; 14*b*,14*b*'. Outer ends 12*b*,12*b*' ultimately will be affixed to the casting mold in a manner to be described below and outer ends 14*b*,14*b*'** ultimately will be abutted against the casting mold also in a manner to be described.

The preformed insert 10 may comprise a metallic or intermetallic material that is preformed by conventional fabrication operations, such as casting, powder metallurgy, plasma spraying, forging, etc., in the desired shape for the composite casting to be made. The preformed insert 10 may comprise a metallic or intermetallic material having a composition similar to or different from that of the melt to be cast therearound. The preformed insert 10 may include reinforcements, such as reinforcing particulates, filaments, and the like, therein. For example, the preformed insert 10 may comprise a metal matrix composite insert comprising a metallic or intermetallic matrix reinforced with suitable reinforcing filaments or particulates. The metal matrix composite may be sheathed with a material compatible with the melt to be cast so as to avoid unwanted reaction between the reinforcement and the cast melt.

The suspension members or pins 12,12'; 14,14' preferably comprise a metallic or intermetallic material having the same or similar, or at least compatible, composition as the composition of the cast melt so as not to degrade the properties of the bicasting ultimately produced. Typically, the suspension pins 12,12'; 14,14' shown in FIG. 1 are formed by severing small diameter wire or rod to appropriate lengths for suspending the insert 10 in the casting mold cavity 30 in a manner to be described hereinbelow.

The slender suspension members 12,12'; 14,14' are preferably provided with a cross-section that is substantially smaller than the cross-section of the relatively bulky preformed insert 10 so as to provide a reduced-area interface between each suspension member 12,12'; 14,14' and the melt cast therearound (as compared to the interface area between the preformed insert 10 and melt cast therearound) effective to inhibit gas penetration to the interface between the preformed insert and the cast melt during a subsequent hot isostatic pressing operation to be described hereinbelow. For example, the ratio of the cross-section of each suspension member 12,12'; 14,14' to the cross-section of the preformed insert 10 typically is in the range of 0.002 to 0.1. A particular ratio of the cross-section of each suspension member 12,12'; 14,14' to that of the preformed insert 10 of about 1/100 has been used in practicing the invention although the invention is not limited to any particular ratio. Suspension members 12,12'; 14,14' having a diameter in the range of about 0.010 to about 0.250 inch are useful in practicing the invention to this end.

Referring to FIG. 1, the preformed insert 10 having the suspension members 12,12'; 14,14' fixed (e.g., welded) to the opposite inner ends **10*b*,10*a* and opposite sides 10*c*,10*d*, respectively, is shown positioned in a ceramic investment casting shell mold 20. The shell mold 20 includes a frusto-conical funnel 22 into which a melt is poured from a suitable source, such as a ladle or crucible, a down sprue 24, and a laterally extending ingate or channel 26 that receives the melt from the down sprue 24. The ingate 26 is communicated to the mold cavity 30 so as to supply the melt thereto to fill the mold cavity 30 and the open-ended post or riser 28 thereabove. The shell mold 20 is fabricated in accordance with conventional shell mold practice wherein a fugitive (e.g., wax) pattern assembly in the configuration of the desired funnel 22, down sprue 24, ingate 26, riser 28 and mold cavity 30 is dipped in a ceramic slurry, stuccoed or sanded with dry ceramic particulates, and then dried in repeated fashion to build up the shell mold 20 thereon. The pattern assembly is selectively removed from the shell mold 20 in conventional manner, such as by melting, dissolving or vaporization of the pattern. Thereafter, the shell mold 20** is fired at elevated temperature to develop proper mold strength for casting. Pattern removal and mold firing typically are conducted to prevent oxidation or other contamination of the insert and suspension members (e.g., using a vacuum or inert gas atmosphere) if the insert is incorporated in the mold during mold manufacture, rather than placed in the mold after mold manufacture, as described hereinbelow.

In accordance with the present invention, the preformed insert 10 is suspended to required location tolerances in the mold cavity 30 by the slender suspension members or pins 12,12'; 14,14' which are affixed at the pin ends **12*a*,12*a*'; 14*a*,14*a*' to the insert 10 as described above. Pin ends 12*b*,12*b*' are fixed to the mold 20** as will now be described.

In particular, the preformed insert 10 having the suspension members 12,12'; 14,14' affixed thereon is inserted into the mold cavity 30 of the fired mold 20 through the open riser 28 until the ends 12*b* of the lower suspension members 12 are received in suitably shaped locating passages 32 formed in the bottom wall 34 of the mold ingate 26 as shown in FIG. 1. The locating passages 32 typically are formed in the bottom mold wall 34 by providing suitable projections (not shown) on the aforementioned wax pattern assembly and then investing the pattern assembly in ceramic as described above. As those skilled in the art will appreciate, the projections on the wax pattern will form corresponding depressions in the bottom mold wall 34 invested thereon. The projections are formed accurately at predetermined locations on the wax pattern so as to yield passages 32 located within required location tolerances in the bottom mold wall 34 to receive the outer ends 12*b* of the lower suspension members 12 as shown and by them in position on the mold. The lower ends 12*b* may optionally be adhered in the passages 32 by suitable ceramic adhesive. In lieu of passages 32 in the bottom mold wall 34, depressions (not shown) may be formed therein for receiving shortened ends 12*b* of each suspension member 12 and fixing them in desired position. The ends 12*b* optionally can be adhered in each throughhole by suitable ceramic adhesive, which would prevent melt leakage.

The mold 20 may be a split mold for assembly about the insert followed by cementing or otherwise clamping or fastening the mold sections together about the insert.

Furthermore, the pattern can be formed about the insert to define the casting shape, the mold can be formed about the pattern/insert, and then the pattern can be removed in a manner to leave the mold about the insert and to avoid contamination of the insert.

The upper suspension members or pins 12' are fixed on a ceramic mold locating plate 40 which is received and glued by ceramic adhesive in the open-ended post or riser 28 as shown in FIG. 1 and thus is considered part of the mold 20. The locating plate 40 includes a pair of locating passages 42 in which the ends 12*b'* of the upper suspension members 12' are received and fixed in desired position. The ends 12*b'* can be optionally adhered in the passages 42 by suitable ceramic adhesive. Typically, in assembling the insert 10 and the mold 20, the insert 10 is inserted into the mold cavity 30 until the lower suspension members 12 are received and located in the passages 32 and then the locating plate 40 is fixed in the riser 28 with the upper suspension members 12' received and fixed in position in the locating passages 42.

Fixation of the lower suspension members 12 in the passages 32 and fixation of the upper suspension members 12' in the passages 42 locates the preformed insert 10 in the longitudinal (e.g., axial) direction within required location tolerances in the mold cavity 30 spaced from the interior walls thereof.

When the insert 10 is positioned in the mold cavity 30 in the manner described hereabove, the outer ends 14*b*,14*b'* of the second pins 14,14' will be in abutting engagement with the inner, upstanding mold walls. The ends 14*b*,14*b'* are not fixed to the mold walls by ceramic adhesive, however.

The suspension members 12,12'; 14,14' exhibit sufficient strength and stiffness and are provided in appropriate orientation and numbers to support the insert 10 in the required position in the mold cavity 30 despite the flow of melt into the mold cavity during casting.

After the preformed insert 10 is positioned in the mold cavity 30, a melt of a selected metallic or intermetallic material is poured from a ladle or crucible (not shown) under vacuum into the mold funnel 22 and travels through the down sprue 24 and ingate 26 into the mold cavity 30 and riser 28. The preformed insert 10 and at least a portion of the suspension members 12,12'; 14,14' are thereby surrounded by the melt. Upon solidification of the melt in the mold 20, a composite casting 50 is produced and includes the preformed insert 10 and at least a portion of the suspension members 12,12'; 14,14' embedded in the cast melt 52, see FIG. 2. Casting and solidification of the melt in-situ about the insert 10 and the suspension members 12,12'; 14,14' in conjunction with the relatively small cross-section of the slender suspension members provide intimate interfaces F between the suspension members and the cast melt 52 that have been found to inhibit gas penetration therebetween in a subsequent hot isostatic pressing operation. Preferably, at least partial or limited metallurgical bonding is achieved between the suspension members 12,12'; 14,14' and the cast melt 52 to this end; i.e., to inhibit gas penetration during hot isostatic pressing. Metallurgical bonding between the suspension members and the cast melt is enhanced if they are partially melted by the melt prior to solidification thereof. A melting point depressant may be provided on the suspension members 12,12'; 14,14' to this end. Use of a melting point depressant would be appropriate where larger cross-section suspension members are required to support the insert in the mold and where the temperature rise of the suspension members is insufficient to promote bonding with the melt. The melting point depressant should be selected so as not to impair the properties of insert and cast melt.

Figure 2:
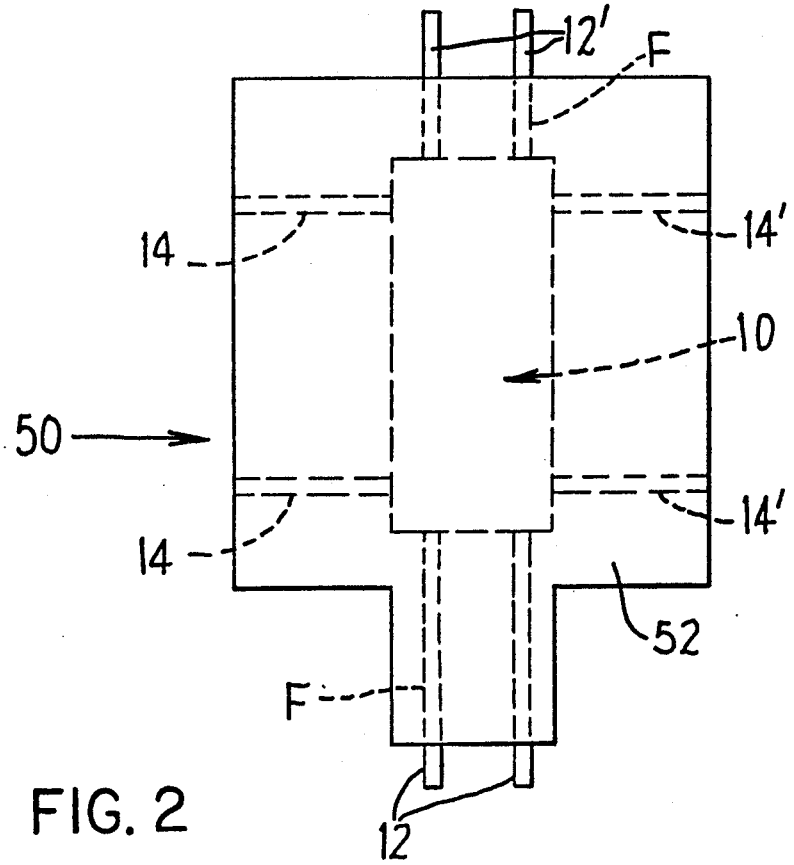
FIG. 2 is a schematic side sectional view of the composite casting formed in the mold of FIG. 1 in accordance with one embodiment of the invention.

Following solidification of the melt, the mold 20 including mold plate 40 are removed by conventional techniques from the composite casting 50 comprising the preformed insert 10 embedded in the cast melt 52 with the suspension members 12,12'; 14,14' extending to exterior surfaces of the cast melt as shown in FIG. 2.

The composite casting is then subjected to a hot isostatic pressing operation or similar operation under elevated temperature/elevated isostatic gas pressure/-time conditions effective to close any voids which may exist between the preformed insert 10 and the cast melt 52 therearound as well as to insure that a complete, sound, uncontaminated metallurgical bond is achieved between the insert 10 and the surrounding cast melt 52. Moreover, the conditions of hot isostatic pressing typically are effective to completely, soundly metallurgically bond the suspension members 12,12'; 14,14' and the surrounding cast melt 52. The particular elevated temperature/elevated pressure/time conditions used will be tailored to the particular melt composition employed, the insert material employed as well as the size of the composite casting produced.

The intimate interfaces F between the suspension members 12,12'; 14,14' and the cast melt 52 have been found to be effective in inhibiting penetration of the isostatic pressing gas, such as argon, to the interface between the insert 10 and the cast melt during the hot isostatic pressing operation. In effect, the insert 10 is embedded inside the cast melt 52 and communicates with the ambient atmosphere only via the reduced-area, intimate interfaces F between the suspension members 12,12'; 14,14' and the cast melt 52, which interfaces F are located externally of the interface between the insert 10 and void-free, contamination-free metallurgical bond is achieved between the insert 10 and the cast melt 52 when penetration of the isostatic pressing gas is effectively prevented in accordance with the invention.

The cast melt in the mold ingate 26 and the mold riser 28 can be removed from the composite casting 50 either prior to or after the hot isostatic pressing operation.

While the invention has been described in terms of specific embodiments thereof, it is not intended to be limited thereto but rather only to the extent set forth in the following claims.

The embodiments of the invention in which an exclusive property or privilege is claimed are defined as follows:

1. A method of making a casting having a preformed insert therein, comprising:

a) providing a casting mold having a melt-receiving mold cavity, b) suspending a preformed metallic or inter-metallic insert in the mold cavity by one or more first elongated, slender suspension members fixed at one end to the insert and fixed at another end to the mold to locate the insert in a first direction in said mold cavity, and by one or more second elongated, slender suspension members fixed at one end to the insert and in abutting engagement to the mold at another end to locate the insert in a second direction in said mold cavity, c) introducing a melt into the mold cavity about the suspended insert and about at least a portion of the suspension members, and d) solidifying the melt in the mold cavity to provide a casting of said solidified melt having the insert disposed therein.

2. The method of claim 1 including the further step of subjecting the casting to elevated temperature and isostatic gas pressure conditions wherein the interface between the suspension members and the solidified melt is effective to inhibit gas penetration between the preformed insert and the solidified melt.

3. The method of claim 2 including providing each suspension member with a cross-section substantially less than the cross-section of said preformed insert to provide a reduced-area interface between each suspension member and the solidified melt effective to inhibit gas penetration between the insert and the solidified melt.

4. The method of claim 3 wherein the ratio of the cross-section of each suspension member to the cross-section of the preformed insert is in the range of about 0.002 to about 0.1.

5. The method of claim 2 wherein each suspension member is at least partially metallurgically bonded to the cast melt to inhibit penetration of the elevated isostatic gas pressure between the preformed insert and the solidified melt.

6. The method of claim 5 wherein each suspension member is partially melted by the melt introduced into the mold to enhance said metallurgical bonding.

7. The method of claim 6 wherein each suspension member includes a melting point depressant to enhance bonding between the cast melt and each suspension member.

8. The method of claim 1 wherein said another end of each said first suspension member is received in an ingate passage of the mold that supplies the melt to the mold cavity and is fixed in position therein so as to locate the insert in preselected position in the mold cavity.

9. The method of claim 1 wherein said another end of each said first suspension member is received in a riser passage of the mold and is fixed in position therein so as to locate the insert in preselected position in the mold cavity.

10. The method of claim 1 wherein each suspension member comprises an elongated pin.

11. The method of claim 1 wherein the preformed insert comprises a metallic or intermetallic material that corresponds in composition to the melt introduced into the mold cavity.

12. The method of claim 11 wherein the metallic or intermetallic material of the insert includes reinforcements therein.

13. The method of claim 12 wherein the reinforcements comprise reinforcing filaments.

* * * * *